US005261137A

United States Patent [19]

Barkdull, Jr.

[11] Patent Number: 5,261,137

[45] Date of Patent: Nov. 16, 1993

[54] METHOD OF SPAN CONSTRUCTION

[76] Inventor: Howard L. Barkdull, Jr., 21 West Dr., Olmsted Township, Cuyahoga County, Ohio 44138

[21] Appl. No.: 882,705

[22] Filed: May 14, 1992

[51] Int. Cl.[5] ..... E01D 21/02; E04G 11/04

[52] U.S. Cl. ..... 14/77.1; 14/24; 52/2.15

[58] Field of Search ..... 14/2, 24, 25, 77.1; 52/2.15, 2.17

[56] References Cited

U.S. PATENT DOCUMENTS

| | | | |
|---|---|---|---|
| 4,170,093 | 10/1979 | Cappellini et al. | 52/2.15 X |
| 4,257,199 | 3/1981 | Kuboyama | 52/2.17 |
| 4,454,620 | 6/1984 | Barkdull, Jr. | 52/2.17 X |
| 4,712,335 | 12/1987 | Barkdull, Jr. | 14/24 X |

FOREIGN PATENT DOCUMENTS

| | | | |
|---|---|---|---|
| 2202252 | 9/1988 | United Kingdom | 52/2.15 |

*Primary Examiner*—Ramon S. Britts
*Assistant Examiner*—James A. Lisehora
*Attorney, Agent, or Firm*—Fay, Sharpe, Beall, Fagan, Minnich & McKee

[57] ABSTRACT

A method of erecting a span between two points is disclosed which comprises the steps of securing an elongated, flexible sheath to the two points; inflating the tubular sheath with a gaseous fluid to form an arched tubular span; maintaining inflation of the arched tubular span to effect a constant pressure differential across the sheath; further increasing the upward force gradient on the sheath by support apparatus; utilizing the arched tubular span as support for a plurality of hollow aluminum troughs; anchoring the troughs at the two end points to erect a permanent load-bearing span between the two end points; and, deflating and removing the tubular sheath.

9 Claims, 4 Drawing Sheets

METHOD OF SPAN CONSTRUCTION

BACKGROUND OF THE INVENTION

The present invention relate to spans, such as bridges, viaducts and the like for carrying vehicular traffic, and more particularly to a method of construction of a span for an aluminum-troughed bridge.

While the invention is particularly directed to the art of span construction, and will thus be described with specific reference thereto, it will be appreciated that the invention is useful in other fields and applications.

INCORPORATION BY REFERENCE

Applicant's U.S. Pat. Nos. 4,712,335 and 4,454,620 are incorporated by reference herein as background information with respect to the present invention.

SUMMARY OF THE INVENTION

The present invention contemplates a new method of spanning two points, which method reduces the time, expense and difficulty generally associated with methods known heretofore for the construction of box-type girder bridges by utilizing an inflatable sheath having hollow tubular members. More specifically, the present invention does away with the disadvantage of boxes extending from their supports thereby resulting in sagging.

In accordance with the present invention, there is provided a method of erecting a span between two points, which method is comprised of the steps of: securing a flexible tubular sheath to the two points; inflating the tubular sheath with a gaseous fluid to form an arched tubular span connecting the points; maintaining inflation of the arched tubular span to effect a constant pressure differential across the tubular sheath; further increasing the upward force gradient on the tubular sheath by support means located at one of the openings to each hollow tubular member; utilizing the arched tubular span as support for a plurality of aluminum troughs running the length of the arched tubular span; anchoring the troughs at the two points to erect a permanent load-bearing span; and, removing the tubular sheath.

The physical structure of the sheath is described and illustrated in applicant's U.S. Pat. No. 4,712,335. A gas source means, such as a turbine t compressor having sufficient capacity to maintain inflation of the sheath, is utilized for forcing gas such as air in the sheath to maintain inflation thereof.

Hollow tubular members of predetermined dimension and spacing transverse the upper and lower sides of the sheath. These tubular members are hollow cylinders comprised of aluminum or magnesium. Support means are located at one of the openings to each hollow cylinder to further increase the upward force gradient on the tubular sheath. The resulting arched tubular span is utilized as support for a plurality of hollow troughs running the length of the arched tubular span. The hollow troughs are preferably comprised of aluminum. The distal ends of the aluminum troughs are permanently anchored to an end support and subsequently reinforced with a combination of a nylon rod running the length of the trough and plasticized cement to erect an aluminum-troughed bridge.

It is an object of the present invention to provide a method of constructing spans, bridges, viaducts and the like.

Another object of the present invention is to provide a method as described above, which method utilizes an inflatable structure as a temporary support on which to build a span.

A further object of the present invention is to provide a method as described above, which method utilizes a single aluminum trough which is continuously strengthened to thereby yield an aluminum-troughed span of superior load-bearing capacity.

A still further object of the present invention is to provide a method of construction as described above, wherein an aluminum-troughed span between two points can be economically constructed.

These and other objects and advantages will become apparent from the following description of a preferred embodiment of the invention taken together with the accompanying drawings.

BRIEF DESCRIPTION OF THE DRAWINGS

The invention may take form in the performance of certain steps which are described in detail in the specification and illustrated in the accompanying drawing wherein.

DETAILED DESCRIPTION OF PREFERRED EMBODIMENT

Figure 1:
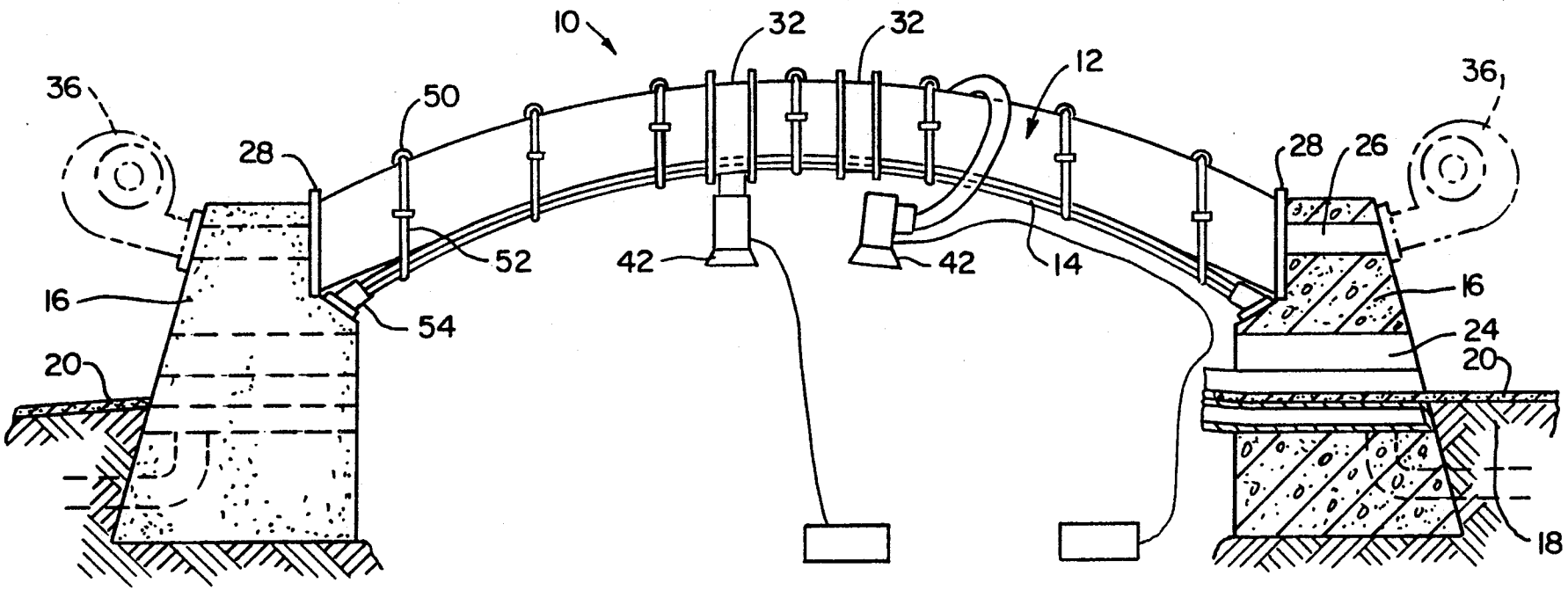
FIG. 1 is a side view, illustrating diagrammatically rather than in proportional dimensions, a span constructed according to the present invention wherein booster motor fans comprise the support means.

Referring now to the drawings wherein the showings are for purposes of illustrating the preferred embodiment of the present invention only and not for purposes of limiting same, a method of erecting an aluminum-troughed span such as a bridge or viaduct is illustrated. With respect to the drawings, the invention will be described with respect to a vehicle bridge wherein the elements are shown diagrammatically rather than in proportional dimensions. Broadly stated, the present invention pertains to a method of erecting a span 10 between two points, comprised of the steps of maintaining the inflation of a sheath 12 having one or more hollow tubular members; further increasing the pressure differential across the sheath 12 as support for an aluminum trough 14; anchoring the trough 14 at the two points; and using the trough 14 as support for a consecutive trough which is secured to the original trough 14 to construct a load-bearing span.

Figure 2:
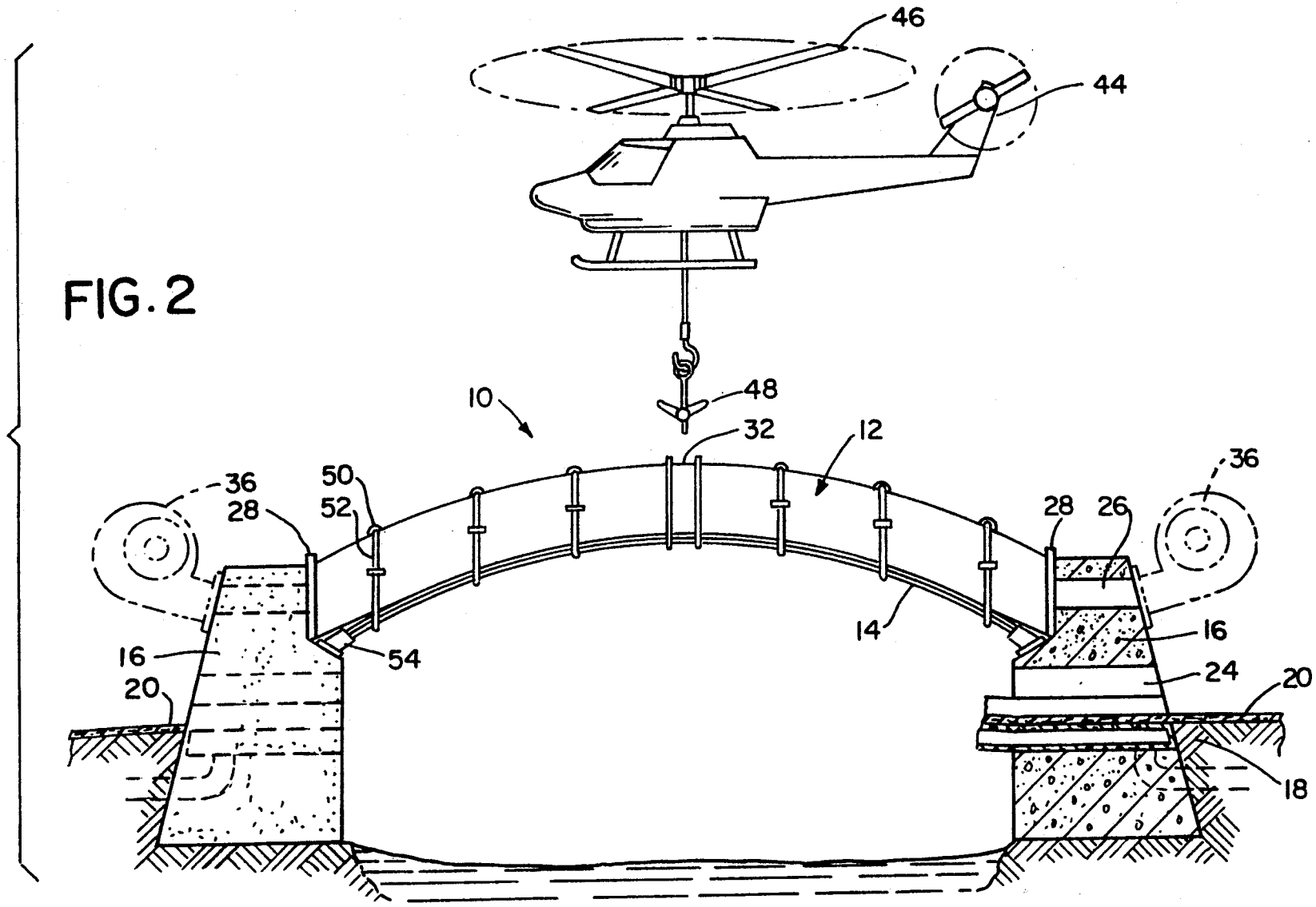
FIG. 2 is a side view, illustrating diagrammatically rather than in proportional dimensions, a span constructed according to the present invention wherein a helicopter comprises the support means.

Referring to FIGS. 1 and 2, two end supports or abutments 16 are provided at the two points to be spanned. In FIGS. 1 and 2, the right end support 16 is shown in section. The end supports 16 are approached by a conventional earth work ramp 18 supporting the paved highway surface 20 at a grade required by the site to join the roadway surface 20 with the completed load-bearing span. Highway surface 20 extends through openings 24 in supports 16. End supports 16 are erected on suitably excavated bed-rock or suitable sub-soil base or, if the site is a deep marsh or such that the sub-soil is unstable and too deep over bed-rock or a stable stratum, the abutments 16 may be erected upon suitable piles or sunken matter slabs in a conventional manner. Abutments 16 are usually a poured reinforced concrete or similar conventional masonry work. To secure abutments 16 to the bed-rock or other base, vertical steel or other high tensile strength anchor rods (not shown) may be used.

A flexible sheath means 12, preferably a rubberized nylon membrane, spans the abutments 16. This sheath 12 is preferably comprised of a flexible material such as a rubberized nylon or plastic sheeting having gas tight flexible joints connecting adjacent sheets. The sheath 12 preferably has a circular cross-sectional configuration when inflated. The sheath 12 is received by annular recesses 28 in the end supports or abutments 16 which are provided with conventional substantially air-tight seals between the end supports 16 and the sheath 12.

Figure 3:
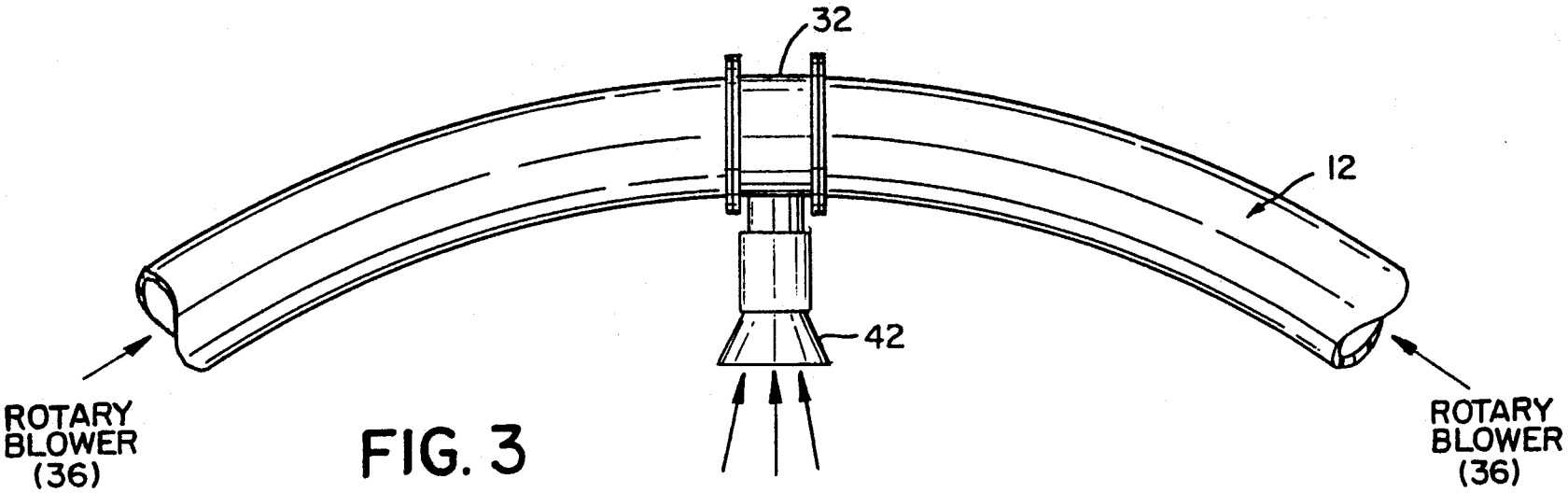
FIG. 3 is a side view of a sheath used in the present invention illustrating a hollow cylinder therein.
Figure 5:
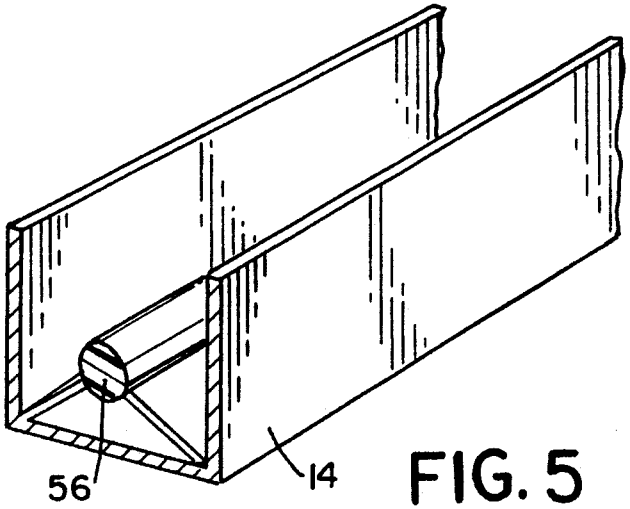
FIG. 5 is a cross-sectional view of a reinforced aluminum trough of the type utilized in the present invention.
Figure 4:
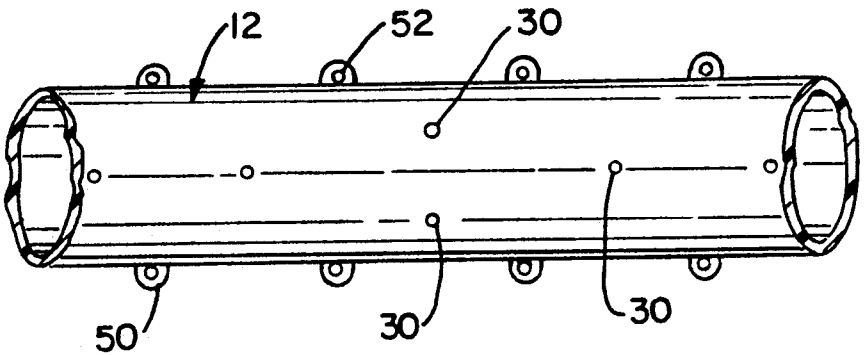
FIG. 4 is a view of the lower side of a sheath used in the present invention illustrating apertures therein.
Figure 6:
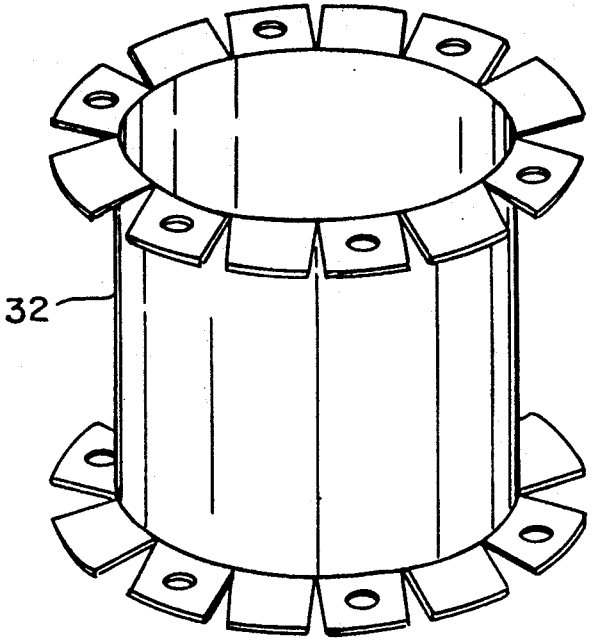
FIG. 6 is a frontal view of a hollow cylinder used in the present invention; and, FIG. 7 illustrates an aluminum-troughed bridge erected in accordance with the present invention.
Figure 7:
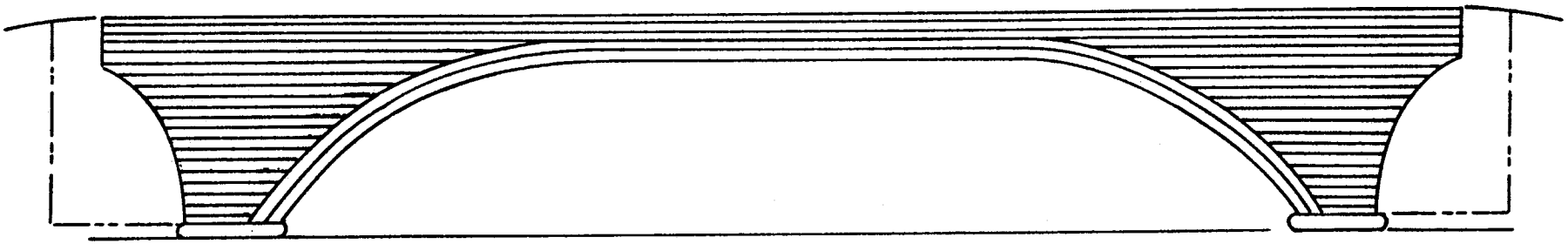

The sheath 12 is provided with gas escape means in the form of apertures 30 along the bottom portion of the sheath 12 as best seen in FIG. 4. The sheath 12 is further provided with hollow tubular members of predetermined dimension and spacing perpendicular to and transversing the upper and lower sides of the sheath 12 as best seen in FIG. 3. The hollow tubular members are preferably hollow aluminum cylinders 32 as best seen in FIG. 6.

A gas source means for forcing a gas, such as air, into one or both ends of the sheath 12 through the abutments 16 is provided to inflate the sheath 12. The gas source means could include a jet engine or other turbine type compressor having sufficient capacity to maintain inflation of the sheath. For the purposes of illustration, the gas source means have been illustrated in phantom as rotary blowers 36 coupled through an opening 26 in the abutment 16 to the sheath 12. Gas is exhausted from the sheath 12 through the aforementioned apertures 30 along the bottom of the sheath 12. The escaping gas produces an area of high pressure below the sheath. This area of high pressure, as compared to the relatively lower pressure above the sheath 12, produces a lift much like the wing of an aircraft. In this respect, the jet of air from the bottom side of the sheath 12 together with the general configuration of the sheath 12 produces a naturally arched configuration as illustrated in FIGS. 1 and 2.

In accordance with the present invention there is provided support means to further increase the upward force gradient on the tubular sheath. The support means are located at one of the openings to each hollow cylinder 32 and may take a number of different forms including booster motor fans 42, small jet engines (not shown) or helicopters 44. In addition to the foregoing support means, balloons (not shown) filled with a gas such as helium may be tied around the sheath 12 at specified intervals to create an additional upward lift on the sheath 12. For purposes of illustration, the support means have been illustrated as booster motor fans 42 (FIG. 1) and a helicopter 44 (FIG. 2).

Booster motor fans 42 are located at the bottom side of the sheath 12 at the opening to each hollow aluminum cylinder 32. The booster motor fans 42 are generally 400 Hz aircraft electric fans operating at a speed of at least 22,000 rpm. These booster motor fans are similar to fan motors once used for inflating aircraft emergency evacuation slides on Boeing 707's and other model commercial planes. The booster motor fans 42 act to further increase the pressure differential across the sheath 12.

Preferably, the support means may also take the form of a helicopter 44. As seen in FIG. 2, the helicopter 44 is positioned directly above the upper side of the sheath 12. A toggle bolt 48 is used to anchor the helicopter 44 to the sheath 12 at the opening to the hollow aluminum cylinder 32. The action of the helicopter rotors 46 is instrumental in further increasing the upward force gradient on the sheath 12. When the amount of fuel in the helicopter 44 runs low, the toggle bolt 48 can easily be released to accommodate another helicopter having the requisite fuel.

The aluminum troughs 14 are fabricated by continuously welding and re-welding three (3) coils of aluminum flatstock as the aluminum is unrolled. According to the present invention, aluminum troughs 14 are fastened to inflated sheath 12. The troughs 14 are preferably erected individually. The troughs 14 are maintained in place by holding means which secure the troughs 14 to the sheath 12. The holding means may take the form of straps 52 as shown in FIGS. 1–2 extending through loops 50 integrally formed on the sheath 12. A trough 14 is permanently anchored to the two points. Their distal ends are received in flanged members 54 which are secured to end supports 16.

Subsequently added aluminum troughs 14 are secured in parallel to the previously anchored troughs 14 by telescoping the ends of the troughs together at the joints using spring snaps (not shown) and U enclosure (not shown). Once a row of multiple troughs is secured in parallel, subsequent troughs are preferably secured to the first row of troughs to form a stable structure having two rows of troughs.

The aluminum trough 14 is subsequently reinforced by a combination of a lightweight rod 56, preferably nylon, running the length of the trough 14 and plasticized concrete. The plasticized concrete is added in an amount capable of completely filling the trough 14. For spans wherein a longer length is desirable, the reinforcing means may consist of pre-stressed wires layered with plasticized concrete.

The invention has been described with reference to the preferred embodiment. Obviously, modifications and alterations will occur to others upon reading and understanding the proceding detailed description of the preferred embodiment. It is intended that the invention be construed as including all such modifications and alterations insofar as they come within the scope of the appended claims or the equivalents thereof.

Having thus described the preferred embodiments, the invention is claimed as follows:

1. A method of erecting a span between two points comprising the steps of:

(a) securing an elongated, flexible tubular sheath to the two points, the tubular sheath having an upper side, a lower side which has apertures of predetermined dimension and spacing disposed therealong, and at least one hollow tubular having two ends and transversing the upper and lower sides of the sheath;

(b) inflating the tubular sheath with a gaseous fluid to form an arched tubular span connecting said points, inflation of the sheath creating a pressure differential between the upper and lower sides of the sheath caused by the gaseous fluid exiting the apertures;

(c) maintaining inflation of the arched tubular span to effect a constant pressure differential across the tubular sheath, the pressure differential creating an upward force gradient on the arched tubular span;

(d) further increasing the upward force gradient on the arched tubular span by support means located at either of the ends of said at least one tubular member;

(e) utilizing the arched tubular span as support for a hollow trough running the length of the arched tubular span;

(f) permanently anchoring the trough at the two points;

(g) utilizing the trough as support to erect a permanent load-bearing span between the two points; and, (h) deflating and removing the tubular sheath.

2. A method as defined in claim 1 wherein the flexible sheath is a plastic tube of circular cross-section.

3. A method as defined in claim 1 wherein said at least one tubular member is a hollow cylinder of circular cross-section.

4. A method as defined in claim 3 wherein the hollow cylinder comprises aluminum or magnesium.

5. A method as defined in claim 1 wherein the support means are booster motor fans.

6. A method as defined in claim 5 wherein the booster motor fans operate at about 400 Hz and a speed of at least 22,000 rpm.

7. A method as defined in claim 1 wherein the support means is a helicopter.

8. A method as defined in claim 7 wherein toggle bolts secure the helicopter to the tubular member.

9. A method of erecting a span between two points comprising the steps of:

(a) securing an elongated, flexible tubular sheath to the two points, the tubular sheath having an upper side, a lower side which has apertures of predetermined dimension and spacing disposed therealong, and at least one hollow cylinder transversing the upper and lower sides of the sheath;

(b) inflating the tubular sheath with a gaseous fluid to form an arched tubular span connecting said points, inflation of the sheath creating a pressure differential between the upper and lower sides of the sheath caused by the gaseous fluid exiting the aperture;

(c) maintaining inflation of the arched tubular span to effect a constant pressure differential across the tubular sheath, the pressure differential creating an upward force gradient on the arched tubular span;

(d) increasing the upward force gradient on the tubular sheath by means of a helicopter, wherein the helicopter is anchored to an opening of said at least one hollow cylinder by means of toggle anchored to an opening of bolts;

(e) utilizing the arched tubular span as support for a hollow trough running the length of the arched tubular span;

(f) permanently anchoring the trough at the two points;

(g) utilizing the trough as support to erect a permanent load-bearing span between the two points;

(h) deflating and removing the tubular sheath.

* * * * *